US012559865B2

(12) United States Patent
Tsudaka et al.

(10) Patent No.: US 12,559,865 B2
(45) Date of Patent: Feb. 24, 2026

(54) POLYCARBONATE FIBERS, FIBER STRUCTURE AND RESIN COMPOSITE BODY

(71) Applicant: KURARAY CO., LTD., Kurashiki (JP)

(72) Inventors: Takeshi Tsudaka, Kurashiki (JP); Hideki Kamada, Kurashiki (JP); Ryokei Endo, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 911 days.

(21) Appl. No.: 17/697,083

(22) Filed: Mar. 17, 2022

(65) Prior Publication Data

US 2022/0205140 A1 Jun. 30, 2022

Related U.S. Application Data

(63) Continuation of application No. PCT/JP2020/035432, filed on Sep. 18, 2020.

(30) Foreign Application Priority Data

Sep. 27, 2019 (JP) ..... 2019-177201

(51) Int. Cl.
*D01D 5/10* (2006.01)
*D01D 1/04* (2006.01)
*D01F 1/07* (2006.01)

(52) U.S. Cl.
CPC ..... *D01D 5/10* (2013.01); *D01D 1/04* (2013.01); *D01F 1/07* (2013.01); *D10B 2331/042* (2013.01); *D10B 2401/20* (2013.01)

(58) Field of Classification Search
CPC ..... D01D 5/10; D01D 1/04; D01F 1/07
USPC ..... 428/364
See application file for complete search history.

(56) References Cited

U.S. PATENT DOCUMENTS

| | | | | |
|---|---|---|---|---|
| 3,214,500 | A * | 10/1965 | Maerov | D01F 6/64 264/210.4 |
| 11,370,195 | B2 | 6/2022 | Katsuya et al. | |
| 2015/0140306 | A1 | 5/2015 | Endo et al. | |
| 2020/0055276 | A1 | 2/2020 | Katsuya et al. | |

FOREIGN PATENT DOCUMENTS

| | | | |
|---|---|---|---|
| GB | 905072 | A | 9/1962 |
| JP | H04-146210 | A | 5/1992 |
| JP | 2009084736 | A | 4/2009 |
| JP | 2010248684 | A * | 11/2010 |
| JP | 2017014368 | A | 1/2017 |
| JP | 2019104898 | A | 6/2019 |
| WO | WO-2014021084 | | 2/2014 |
| WO | WO-2018199091 | A1 | 11/2018 |

OTHER PUBLICATIONS

Machine translation of JP-2010248684-A (Year: 2010).*
English translation of the International Preliminary Report on Patentability and Written Opinion mailed Apr. 7, 2022 in PCT/JP2020/035432, 6 pages.
Extended European Search Report issued Mar. 15, 2024 in corresponding European Patent Application No. 20869795.3, 7 pages.
International Search Report issued Nov. 24, 2020 in PCT/JP2020/035432 (with English translation), 4 pages.

* cited by examiner

*Primary Examiner* — Vincent Tatesure
(74) *Attorney, Agent, or Firm* — Element IP, PLC

(57) ABSTRACT

Provided are a polycarbonate fiber having a specific orientation degree and/or a specific birefringence value, a fiber structure as well as a resin composite body. The polycarbonate fiber may have an orientation degree (ft) of lower than 0.70, the orientation degree (ft) being defined by the following formula: $ft=1-(1.0/C)^2$, C: obtained sonic velocity (km/sec), and may have a birefringence value of 0.04 or lower. The polycarbonate fiber may comprise a polycarbonate resin having a number-average molecular weight (Mn) of from 12000 to 40000 and/or a weight-average molecular weight (Mw) of from 25000 to 80000.

20 Claims, No Drawings

POLYCARBONATE FIBERS, FIBER STRUCTURE AND RESIN COMPOSITE BODY

CROSS REFERENCE TO THE RELATED APPLICATION

This application is a continuation application, under 35 U.S.C. § 111(a), of international application No. PCT/JP2020/035432 filed Sep. 18, 2020, which claims priority to Japanese patent application No. 2019-177201, filed Sep. 27, 2019, the entire disclosures of all of which are herein incorporated by reference as a part of this application.

FIELD OF THE INVENTION

The present invention relates to a polycarbonate fiber having a specific orientation and/or a specific birefringence value as well as to a fiber structure including such fibers. The present invention further relates to a resin composite body comprising molten material of such fibers to form a matrix of the resin composite body.

BACKGROUND OF THE INVENTION

Polycarbonate resins with high impact resistance are used for applications such as panels and boards, and are also subjected to injection molding to form light covers used in automobiles and the like, as well as helmets for motorcycles.

On the other hand, there has been proposed use of fiberized polycarbonate resin as a molding matrix. For example, Patent Document 1 (JP Laid-open Patent Publication No. H4-146210) proposes polycarbonate multifilament yarns used as a molding matrix resin for a product, characterized in that the multifilament yarns are obtained by subjecting a polycarbonate resin to melt spinning, optionally further drawing, and the multifilament yarns have a birefringence index of from 0.01 to 0.03 and an elongation at break of from 40% to 100%.

Patent Document 2 (International Publication No. WO 2014/021084) proposes a production of a resin composite body, by melt spinning a polycarbonate resin to give polycarbonate fibers, mixing the polycarbonate fibers, carbon fibers and binder fibers to give a dry-laid nonwoven fabric, subjecting an overlay of a plurality of the dry-laid nonwoven fabrics to thermocompression to make the polycarbonate fibers molten so as to produce a resin composite body.

CONVENTIONAL ART DOCUMENT

Patent Document

[Patent Document 1] JP Laid-open Patent Publication No. H4-146210

[Patent Document 2] International Publication No. WO 2014/021084

SUMMARY OF THE INVENTION

However, the polycarbonate fibers obtained in Patent Document 1 cannot have an orientation degree controlled within a predetermined range because the polycarbonate fibers are produced by spinning a polycarbonate resin having a high molecular weight at a low temperature. Further, a melt-molding temperature of a molded body formed from the polycarbonate fibers is no more than 250° C., so that the resulting molded body does not have excellent heat resistance at high temperature.

The melt spinning in Patent Document 2 does not make it possible to control an orientation degree of the polycarbonate fibers within a predetermined range either, presumably because the melt spinning is carried out at a low spinning temperature. Where a fabric made of solely such polycarbonate fibers is subjected to heating so as to make the fibers molten and form a resin composite body, there is a problem that the resulting resin molded body has resin spots, warps and/or twists because of large shrinkage of the polycarbonate fibers due to their considerable decrease in orientation degree during the fiber melting process.

As a result of intensive studies conducted by the inventors of the present invention to solve the problem, the inventors have found that as it is necessary that a polycarbonate fiber useful for a matrix of a molded body not only has sufficient fluidity in molding, but also assures sufficient physical properties of the molded body. The inventors have also found that where spinning is carried out at a higher spinning temperature than one in a conventional spinning process to improve kneadability of the resin, the discharged polycarbonate fibers achieve controlled orientation and/or birefringence within predetermined ranges.

The inventors have further found that polycarbonate fibers having such orientation and/or birefringence, surprisingly, have improved moldability and enable to reduce shrinkage of the fibers in a melt-molding process even where these fibers are molten at high temperature to be used as a matrix of a molded body, so that the resulting resin molded body can successfully suppress resin spots, warps and/or twists in the molded body. The present inventors have thus achieved the present invention.

That is, the present invention may include the following aspects.

Aspect 1

A polycarbonate fiber having an orientation degree (ft) of lower than 0.70 (preferably 0.68 or lower, more preferably 0.65 or lower, further preferably 0.62 or lower, and particularly preferably 0.61 or lower), the orientation degree (ft) being defined by the following formula:

$$ft=1-(1.0/C)^2$$

C: obtained sonic velocity (km/sec).

Aspect 2

A polycarbonate fiber having:

an orientation degree (ft) of lower than 0.70 (preferably 0.68 or lower, more preferably 0.65 or lower, further preferably 0.62 or lower, and particularly preferably 0.61 or lower), the orientation degree (ft) being defined by the following formula:

$$ft=1-(1.0/C)^2$$

C: obtained sonic velocity (km/sec); and a birefringence value of 0.040 or lower (preferably 0.035 or lower, more preferably 0.030 or lower, further preferably 0.025 or lower, and particularly preferably lower than 0.010).

Aspect 3

The polycarbonate fiber according to aspect 1 or 2, wherein the polycarbonate fiber comprises a polycarbonate resin having a number-average molecular weight (Mn) of from 12000 to 40000 (preferably from 15500 to 25000) and/or a weight-average molecular weight (Mw) of from 25000 to 80000 (preferably from 35000 to 65000, and more preferably from 45000 to 55000).

Aspect 4

A polycarbonate fiber having a birefringence value of 0.040 or lower (preferably 0.035 or lower, more preferably 0.030 or lower, further preferably 0.025 or lower, and particularly preferably lower than 0.010), the polycarbonate fiber comprising a polycarbonate resin having a number-average molecular weight (Mn) of from 12000 to 40000 (preferably from 15500 to 25000) and/or a weight-average molecular weight (Mw) of from 25000 to 80000 (preferably from 35000 to 65000, and more preferably from 45000 to 55000).

Aspect 5

The polycarbonate fiber according to any one of aspects 1 to 4, wherein the polycarbonate fiber has a molecular weight distribution (Mw/Mn) of from 2.0 to 4.0 (preferably from 2.2 to 4.0, more preferably from 2.5 to 3.5, further preferably from 2.7 to 3.3, and particularly preferably from 2.7 to 3.1).

Aspect 6

The polycarbonate fiber according to any one of aspects 1 to 5, wherein the polycarbonate fiber has an elastic modulus of 30 cN/dtex or lower (preferably 27 cN/dtex or lower, more preferably 25 cN/dtex or lower).

Aspect 7

The polycarbonate fiber according to any one of aspects 1 to 6, wherein the polycarbonate fiber has a coefficient of variation in a fiber diameter of 15% or lower (preferably 10% or lower, and more preferably 5% or lower).

Aspect 8

The polycarbonate fiber according to any one of aspects 1 to 7, wherein the polycarbonate fiber has a single fiber fineness of 10 dtex or smaller (preferably 4.5 dtex or smaller, and more preferably 3.5 dtex or smaller).

Aspect 9

The polycarbonate fiber according to any one of aspects 1 to 8, wherein the polycarbonate fiber has an elongation at break of 20% or higher (preferably 40% or higher, more preferably 80% or higher, and further preferably 103% or higher).

Aspect 10

The polycarbonate fiber according to any one of aspects 1 to 9, wherein the polycarbonate fiber comprises a polycarbonate resin including bisphenol-A units at a proportion (mol %) of 65% or higher (preferably 75% or higher) based on a total amount of monomer units in the polycarbonate resin.

Aspect 11

The polycarbonate fiber according to any one of aspects 1 to 10, wherein the polycarbonate fiber comprises a phosphorus-based flame retardant.

Aspect 12

The polycarbonate fiber according to aspect 11, wherein the polycarbonate fiber comprises at least one phosphorus-based flame retardant selected from a group consisting of a phosphoric acid ester-based flame retardant, a phosphoric acid salt-based flame retardant, and a phosphazene-based flame retardant.

Aspect 13

A fiber structure comprising polycarbonate fibers as recited in any one of aspects 1 to 12.

Aspect 14

The fiber structure according to aspect 13, wherein the fiber structure is commingled fibers, a woven fabric, or a non-woven fabric.

Aspect 15

A method for producing polycarbonate fibers, the method comprising:

melt-kneading a polycarbonate resin at a high temperature of 305° C. or higher (preferably 310° C. or higher, and further preferably 315° C. or higher) to give a molten polymer;

discharging the molten polymer through a spinning nozzle at a predetermined rate to give as-spun fibers; and winding the as-spun fibers at a predetermined winding speed.

EFFECTS OF THE INVENTION

A polycarbonate fiber according to the present invention can have a controlled orientation degree, so that it is possible to reduce shrinkage occurring in the fiber in melt-molding processing at high temperature and thereby to suppress resin spots, warps and/or twists in a molded body. Thus, the polycarbonate fiber can have improved moldability.

DESCRIPTION OF THE EMBODIMENTS

Polycarbonate Resin

Hereinafter, the present invention will be described in detail. First, a polycarbonate resin which constitutes a polycarbonate fiber according to the present invention will be described. The polycarbonate resin used in the present invention is a polymer including a repeating unit expressed by the following formula and is not limited to a specific one as long as the polymer has melt-formability.

Chem. 1

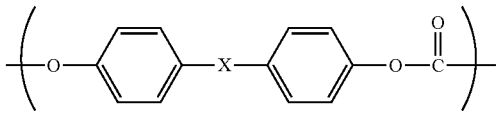

In the formula, X may be direct bonding (none), an alkylene group having 1 to 8 carbon atoms, an alkylidene group having 2 to 8 carbon atoms, a cycloalkylene group having 5 to 15 carbon atoms, a cycloalkylidene group having 5 to 15 carbon atoms, an oxygen atom, a sulfur atom, —CO—, —SO—, and —$SO_2$—.

The polycarbonate resin may preferably include bisphenol-A skeletons (units) in which X is a methylene group. For example, the polycarbonate resin may include bisphenol-A units at a proportion (mol %) of 65% or higher, and preferably 75% or higher based on a total amount of monomer units in the polycarbonate resin. The polycarbonate resin may include a branched chain with a branching degree preferably below 0.1 mol %. As used herein, the branching degree represents a proportion (mol %) of a total number of moles of branched structure units based on one mole of polycarbonate repeating units. The branched structure units represent, among the polycarbonate repeating units, repeating units in which an ester bond (—COO—) is bound to an aromatic ring as a substituent group.

The polycarbonate resin used in the present invention may have a weight-average molecular weight (Mw) of from about 25000 to about 80000, preferably from about 35000 to about 65000, and more preferably from about 45000 to about 55000. A polycarbonate resin having a weight-average molecular weight below the range may result in deterioration in dimensional stability of resulting fibers and mechanical properties when such fibers are formed into a molded body such as a composite. A polycarbonate resin having a weight-average molecular weight above the range may lead to deterioration in melt spinnability in fiberization and reduced impregnation performance in a composite. The polycarbonate resin may have a number-average molecular weight (Mn) of from about 12000 to about 40000, and preferably from about 15500 to about 25000. A polycarbonate resin having a number-average molecular weight within the above range lead to good dimensional stability ofresulting fibers and good mechanical properties when such fibers are formed into a molded body such as a composite.

In terms of fluidity in melt spinning and physical properties of a polycarbonate fiber and a molded product thereof, the polycarbonate resin used in the present invention may have a molecular weight distribution (Mw/Mn), which is a ratio of the weight-average molecular weight (Mw) to the number-average molecular weight (Mn), of from 2.0 to 4.0 (for example from 2.2 to 4.0), preferably from 2.5 to 3.5, more preferably from 2.7 to 3.3, and particularly preferably from 2.7 to 3.1.

The number-average molecular weight (Mn), the weight-average molecular weight (Mw), and the molecular weight distribution can be determined, for example, as the molecular weight of polystyrene by gel permeation chromatography (GPC) which is a kind of a size exclusion chromatography (SEC).

The polycarbonate resin may have, for example, a melt viscosity at a temperature of 320° C. and a shear rate of 1000 $sec^{-1}$ of from 600 to 4000 poise, and more preferably from 800 to 3000 poise.

The polycarbonate resin may have a melt flow rate (MFR) of for example from 8 to 20 g/10 min, and more preferably from 11 to 18 g/10 min, which is measured in accordance with ISO1183.

The polycarbonate resin used in the present invention may contain a flame retardant, a thermal stabilizer, an antioxidant, a radical inhibitor, a delustering agent, an ultraviolet absorption agent, a colorant, and other polymers within the range that they do not inhibit the effect of the present invention.

In particular, where the polycarbonate fiber is used for flame retardant applications, the polycarbonate resin may preferably contain a flame retardant. Any suitable flame retardant may be selected as long as the polycarbonate resin can be melt-spun. In terms of suppressing aggregation of a flame retardant, a phosphorus-based flame retardant may be preferably used.

More specifically, examples of flame retardants may include: phosphoric acid ester-based flame retardants such as triphenyl phosphate-based retardants, aromatic condensed phosphoric acid ester-based retardants, tricresyl phosphate-based retardants, trixylenyl phosphate-based retardants, cresyl phenyl phosphate-based retardants, 2-ethylhexyl diphenyl phosphate-based retardants, aromatic phosphoric acid ester-based retardants, tris(dichloropropyl) phosphate-based retardants, tris(β-chloropropyl)phosphate-based retardants, halogen-containing phosphoric acid ester-based retardants; phosphoric acid salt-based flame retardants such as polyphosphoric acid salt-based retardants; phosphazene-based flame retardants; and red phosphorus-based flame retardants. These flame retardants may contain copolymers. Among these, a phosphoric acid ester-based flame retardant, a phosphoric acid salt-based flame retardant, or a phosphazene-based flame retardant may be preferably used as the phosphorus-based flame retardant.

The phosphorus-based flame retardant may be contained in the polycarbonate fiber at a concentration of for example from about 20 ppm to about 20000 ppm in terms of phosphorus, and preferably from about 40 ppm to about 18000 ppm.

Polycarbonate Fiber

The polycarbonate fiber according to the present invention has a specific orientation degree, so that shrinkage under a high-temperature condition can be reduced.

As for an orientation degree of molecules as a whole, a sonic velocity may be determined to calculate an orientation degree ft by the following formula:

$$ft=1-(1.0/C)^2$$

C: obtained sonic velocity (km/sec)

wherein 1.0 is a sonic velocity of non-oriented polycarbonate polymer.

The polycarbonate fiber may have an orientation degree of lower than 030, preferably 0.68 or lower, more preferably 0.65 or lower, further preferably 0.62 or lower, and particularly preferably 0.61 or lower. There is no particular restriction on a lower limit for the orientation degree, and it may be 0.1 or higher.

The polycarbonate fiber according to the present invention may have a birefringence value controlled to a specific range presumably because the polycarbonate fiber is produced by a specific production method. The birefringence value may be 0.040 or lower, preferably 0.035 or lower, more preferably 0.030 or lower, further preferably 0.025 or lower, and particularly preferably lower than 0.010. There is no particular restriction on a lower limit for the birefringence value, and it may be 0.0001 or higher. The birefringence value is determined in accordance with the method described in Examples.

The polycarbonate fiber according to the present invention may preferably have improved flame retardancy. For example, the polycarbonate fiber may have a limiting oxygen index value (LOI value) of 22.0 or higher, preferably 23.0 or higher, more preferably 24.0 or higher, further preferably 26.0 or higher, and particularly preferably 28.0 or higher. Although it is desirable for the fiber to have an LOI value as high as possible, the LOT value is 40 or lower in many cases. A resin constituting the polycarbonate fiber according to the present invention (which may contain a flame retardant) may have a limiting oxygen index value (LOI value) within the above range. The limiting oxygen index value of the fiber herein is determined in accordance with the method described in Examples.

Further, the polycarbonate fiber according to the present invention may have a single fiber fineness which is set in accordance with the intended use, and the single fiber fineness may be for example 10 dtex or smaller. In a case where the polycarbonate fibers are used as a molding matrix, the polycarbonate fibers may have a single fiber fineness of preferably 4.5 dtex or smaller, and more preferably 3.5 dtex or smaller in terms of mixability with reinforcing fibers. There is no particular restriction on a lower limit for the single fiber fineness, and it may be for example about 0.3 dtex.

Since the polycarbonate fiber according to the present invention is produced by a specific production method, the polycarbonate fiber can have a reduced coefficient of variation (CV) in a fiber diameter. For example, the coefficient of variation in the fiber diameter may be 15% or lower, preferably 10% or lower, and more preferably 5% or lower. The coefficient of variation in the fiber diameter is determined in accordance with the method described in Examples. A lower coefficient of variation is preferable in that uniformity in melting can be improved when the fibers are melt-molded.

The polycarbonate fiber according to the present invention may have, for example, a tenacity (strength at break) at room temperature of 0.8 cN/dtex or higher, and preferably 1.0 cN/dtex or higher. There is no particular restriction on an upper limit for the tenacity, and it may be for example about 4.0 cN/dtex. The tenacity is determined in accordance with the method described in Examples.

The polycarbonate fiber according to the present invention may have, for example, an elongation at break of 20% or higher, preferably 40% or higher, more preferably 80% or higher, and further preferably 103% or higher at room temperature (25° C.). There is no particular restriction on an upper limit for the elongation at break, and it may be for example about 200%. The elongation at break is determined in accordance with the method described in Examples.

The polycarbonate fiber according to the present invention may have, for example, an elastic modulus of 30 cN/dtex or lower, preferably 27 cN/dtex or lower, and more preferably 25 cN/dtex or lower at room temperature. There is no particular restriction on a lower limit for the elastic modulus, and it may be for example about 5 cN/dtex. The elastic modulus is determined in accordance with the method described in Examples.

The polycarbonate fiber according to the present invention may have a glass transition temperature (Tg) of 135° C. or higher, preferably 140° C. or higher, and more preferably 145° C. or higher for the sake of heat resistance of a molded body. The glass transition temperature is determined in accordance with the method described in Examples.

The polycarbonate fiber according to the present invention can have a reduced dry-heat shrinkage percentage at high temperature (for example, from about 110° C. to about 170° C.) in order to suppress e.g., resin spots, warps and/or twists occurring in a molded body. For example, the polycarbonate fiber may have a dry-heat shrinkage percentage of 8% or lower, preferably 5% or lower, more preferably 3.5% or lower, further preferably 2% or lower, and particularly preferably 1.5% or lower at 140° C. under no tension. There is no particular restriction on a lower limit for the dry-heat shrinkage percentage, and it may be for example about 0.5%, and preferably 0%. The dry-heat shrinkage percentage is determined in accordance with the method described in Examples described below.

Method for Producing Polycarbonate Fibers

Specifically, the polycarbonate fiber according to the present invention can be manufactured by melt spinning at high temperature so as to achieve a specific orientation degree and/or a specific birefringence value. A method for producing polycarbonate fibers comprises: melt-kneading a polycarbonate resin at a high temperature (for example, 305° C. or higher) to give a molten polymer; discharging the molten polymer through a spinning nozzle at a predetermined rate to give as-spun fibers (or molten raw fibers); and winding the as-spun fibers (or molten raw fibers) at a predetermined winding speed (or spinning speed).

More specifically, polycarbonate fibers according to the present invention can be produced by melt-spinning using known melt-spinning apparatuses. For example, pellets of a polycarbonate resin are melt-kneaded by using a melt extruder to obtain a molten polymer, and then the molten polymer is fed to a spinning tube. The molten polymer is metered using a gear pump to discharge a predetermined amount from a spinning nozzle, and the discharged fibers are wound up to produce polycarbonate fibers according to the present invention. Since the fibers wound up after melt spinning already have a desired small fineness, the as-spun fibers can be directly used without drawing.

Where melt-kneading is performed at a high heating temperature, the polycarbonate resin has a reduced melt viscosity, leading to a lower spinning tension, so that it is possible to reduce orientation degree and/or birefringence value of the fibers. Although the heating temperature can be suitably set depending on the type of polycarbonate resin, in terms of controlling the orientation degree and/or the birefringence value of the polycarbonate fibers, the heating temperature may be preferably 305° C. or higher, more preferably 310° C. or higher, and further preferably 315° C. or higher. An upper limit for the heating temperature varies depending on the decomposition temperature of the resin and may be for example about 350° C.

The spinneret may have a spinning hole size (single hole size) of, for example, from about 0.02 $mm^2$ to about 1 $mm^2$, preferably from about 0.03 $mm^2$ to about 0.5 $mm^2$, and more preferably from about 0.05 $mm^2$ to about 0.15 $mm^2$. In addition, the configuration of the hole may be suitably selected depending on a required fiber configuration in the cross section. The nozzle may have tapered holes in order to reduce fiber orientation. In particular, each tapered hole may have an enlarging diameter in a discharge direction at an angle of from 3° to 25° with respect to a center axis of that discharge hole of the spinneret.

The discharging amount of the polymer from a spinning nozzle can be suitably set depending on the number of holes in the nozzle or the hole size. The discharging amount may be for example about 10 g/min to about 300 g/min, and preferably about 20 g/min to about 280 g/min.

The discharging speed (rate) of the polymer from a spinning nozzle can be suitably set depending on the viscosity of the molten polymer at the spinning temperature, the nozzle hole size and/or the discharging amount. The discharge speed may be set relatively slow so as to reduce a shear stress on the molten polymer through the nozzle. For example, the discharge speed may be set in a range of from 2.54 to 42.4 m/min, preferably from 4.24 to 33.9 m/min, and more preferably from 4.24 to 25.4 m/min.

The winding speed (spinning speed) of the discharged fibers can be suitably set depending on the nozzle hole size or the discharging amount. From the viewpoint of preventing molecule orientation in the fibers in the spinning direction, the winding speed may be preferably within a range of from 500 to 4000 m/min, more preferably from 600 to 3000 m/min, further preferably from 800 to 2500 in/min, and particularly preferably from 800 to 2000 m/min.

In terms of adjusting orientation of the fibers, the fibers may be subjected to spinning at a drafting ratio (i.e., a ratio of the discharging speed to the winding speed) within a range of for example from 2 to 300, preferably from 5 to 200, more preferably from 20 to 150, and further preferably from 30 to 100.

In terms of reducing the dry-heat shrinkage percentage, the polycarbonate fiber according to the present invention may be preferably obtained directly without drawing the as-spun fibers discharged from the spinning nozzle, or be obtained by drawing the as-spun fibers with a lowest possible drawing ratio (for example, with a drawing ratio of from about 1.0 to 1.3).

The polycarbonate fiber according to the present invention can be used in any fiber form, such as staple fibers, shortcut fibers, filament yarns, spun yarns, strings, and ropes.

The polycarbonate fiber may be a non-composite fiber or a composite fiber. Moreover, there is no specific restriction on the configuration of the fiber in the cross section, and the cross-sectional configuration of the fiber may be circular, hollow, or a variant form such as a star.

Further, the polycarbonate fiber according to the present invention can also be used in a fabric form. Such a fabric is not limited to a specific form as long as the fabric includes the polycarbonate fibers according to the present invention. The fabric may take various forms, such as nonwoven fabrics (including paper), woven fabrics, and knitted fabrics. Such a fabric may be produced with the polycarbonate fibers by a known or conventional method.

The polycarbonate fabric according to the present invention may preferably include fibers having a small fineness because such a polycarbonate fabric can achieve improved uniformity when the polycarbonate fabric is melted to form a resin composite body. This is also preferable in case of a nonwoven fabric because such a fabric makes it possible to form a nonwoven fabric having excellent mixability.

As long as the effect of the present invention is not spoiled, the polycarbonate fiber may be used in combination with other type of fiber(s). The polycarbonate fabric comprises polycarbonate fibers according to the present invention, for example, as subject fibers, and the content of the polycarbonate fibers in the whole fabric may be 50 mass % or higher, preferably 80 mass % or higher, and particularly 90 mass % or higher. Such a fabric (especially paper and nonwoven fabric) can realize a fabric advantageously exhibiting properties of the polycarbonate fibers.

The polycarbonate fiber and the polycarbonate fabric can be highly effectively used in various forms for various applications in industrial material fields, agricultural material fields, civil engineering material fields, electrical and electronic fields, optical material fields, aircraft, automobile, and vessel fields, etc.

Method for Producing Resin Composite Body

A method for producing a resin composite body according to the present invention at least comprises: preparing the polycarbonate fibers or the fabric; and thermoforming the polycarbonate fibers or the fabric at a temperature equal to or higher than a glass transition temperature of the polycarbonate resin.

The thermoforming process is not limited to a specific one as long as the polycarbonate fibers or the fabric can be melted to form an integrated material, and a general forming process for a resin composite body may suitably be used. The resin composite body may be thermoformed under pressure. The pressure is not limited to a specific magnitude and may be typically 0.05 $N/mm^2$ or higher (for example, from 0.05 to 15 $N/mm^2$). Further, the thermoforming period is not limited to a specific time length, and may be preferably 30 minutes or shorter in typical cases because exposure to high temperature for a long period of time may lead to deterioration of the polymer.

The resin composite body is not limited to a specific form and may be shaped in a suitable form according to the intended use. In the thermoforming, a plurality of fabrics each having different characteristics from each other can be layered, or a plurality of fabrics each having different characteristics from each other can be separately arranged in a mold having a certain dimension. In some cases, other reinforcing fiber woven fabric(s) and/or resin composite body (or bodies) may be used in combination to obtain a molded body. Depending on the intended use, a once-thermoformed resin composite body can be subjected to further thermoforming.

The resin composite body according to the present invention may preferably have a density of 2.00 $g/cm^3$ or lower. A resin composite body having a density higher than 2.00 $g/cm^3$ cannot be considered to contribute to weight reduction, so that such a resin composite body may have limited applications. The resin composite body may preferably have a density of 1.95 $g/cm^3$ or lower, and more preferably 1.90 $g/cm^3$ or lower. A lower limit for the density may be suitably set depending on selection of material and may be for example about 0.5 $g/cm^3$.

The resin composite body according to the present invention may preferably have a thickness of 0.3 mm or larger (preferably 0.5 mm or larger). A resin composite body having a too small thickness may lead to a resultant resin composite body having a low strength or higher production costs. The resin composite body may more preferably have a thickness of 0.7 mm or larger, and further preferably 1 mm or larger. An upper limit for the thickness may be suitably set depending on a required thickness of the resin composite body and may be for example about 10 mm.

The resin composite body according to the present invention not only has excellent mechanical properties and heat resistance, but also can be manufactured at low cost without requiring a special process. Therefore, the resin composite body can be suitably used for various applications including, for example, case bodies for personal computers, displays, office automation (OA) devices, mobile phones, mobile information terminals, digital video cameras, optical devices, audio devices, air conditioners, lighting devices, toys, electrical/electronic equipment components, and other home appliances; civil engineering and construction materials such as interior materials, exterior materials, supports or braces, panels, and reinforcing materials; various members, various frames, various hinges, various arms, various axles, various wheel bearings, various beams, various pillars, various beams, various supports, various rails for vehicles (automobiles, motorcycles, vessels, aircraft, etc.); vehicle interior components such as instrument panels, seat frames, door trims, pillar trims, steering wheels and handle bars, and various modules; vehicle exterior components such as chassis, trays, outer plates, body parts, bumpers, moldings, underbody covers, engine covers, rectifying flaps, spoilers, cowl louvers, aerodynamic parts; components for fuel systems, exhaust systems, or intake systems of vehicles, such as motor parts, compressed natural gas (CNG) tanks, gasoline tanks, fuel pumps, air intakes, intake manifolds, carburetor main bodies, carburetor spacers, various pipes, various valves; and components for drones and aircrafts, such as landing gear pods, winglets, spoilers, edges, rudders, elevators, failings, and ribs.

EXAMPLES

Hereinafter, the present invention will be described in more detail with reference to Examples which are not to be construed as limiting the scope of the present invention. In the following Examples, various physical properties were determined in the following manners.

Molecular Weight Distribution (Mw/Mn)

A molecular weight distribution of each sample was measured by using the gel permeation chromatography (GPC) available from SHODEX with GPC101 (polystyrene conversion). After dissolving each sample in tetrahydrofuran as a solvent to have a concentration of 0.2 mass %, the solution was filtered and measured. The molecular weight distribution (Mw/Mn) was calculated from a ratio of the measured weight-average molecular weight (Mw) to the measured number-average molecular weight (Mn).

Orientation Degree

An overall molecular orientation was determined from a sonic velocity. The sonic velocity was measured using Rheovibron DDV-5-B. A bundle of fibers with 50-cm long was fixed to the device, applying a tension with a load of 0.1 g/dtex. A sonic pulse was transmitted from a sound source to a detector to measure a propagation time at each of points 50 cm, 40 cm, 30 cm, 20 cm, and 10 cm away from the sound source. The sonic velocity was calculated from a relation between distance and propagation time (n=5).

After the sonic velocity which indicates the orientation degree of the whole molecules was calculated, the orientation degree ft was calculated by the following formula:

$$ft=1-(1.0/C)^2$$

C: obtained sonic velocity (km/sec).

Birefringence Value

Using a polarizing microscope "BX53" available from Olympus Corporation, which included a Berek compensator, a retardation was measured under a light source with λ=546.1 nm (e-line), and a birefringence value was calculated from the retardation by the following formula:

$$\Delta n=R/d$$

Δn: birefringence value, R: retardation (nm), d: fiber thickness (nm).

Tenacity and Elastic Modulus (cN/dtex)

In accordance with the JIS L1013 test method, a preconditioned yarn was prepared for each sample, and a tenacity of each sample having a sample length of 20 cm was measured at room temperature (25° C.) under a condition of an initial load of 0.18 cN/dtex and a tensioning speed of 10 cm/min. An average of 10 samples was adopted. A fiber fineness (dtex) of each sample was measured by a mass method.

Dry-Heat Shrinkage Percentage (%) Under No Tension

A fiber cut to a length of 10 cm or a fabric comprising fibers and cut to a size of 10-cm square was placed in a thermostatic air chamber maintained at 140° C. After retainment for 30 minutes with the ends of the fiber or fabric unfixed, a fiber length or a fabric length (X cm) was measured, and a dry-heat shrinkage percentage was calculated by the following formula:

$$\text{Dry-heat shrinkage percentage (\%)}=\{(10-X)/10\}\times 100$$

Glass Transition Temperature Tg (° C.)

A glass transition temperature of a fiber was determined using a differential scanning calorimeter "TA3000-DSC" produced by Mettler. The glass transition temperature was determined as an inflection point of a DSC chart where the fiber was subjected to heating to a temperature of 350° C. at a heating rate of 10° C./min in a nitrogen atmosphere.

Limiting oxygen index (LOI) Value of Fiber

In accordance with the JIS K7201 test method, each sample having a sample length of 18 cm was prepared by braiding fibers. When fire was set at an upper end of each sample, a minimum oxygen concentration was determined in order for the sample to continuously burn for a burning time of 3 minutes or longer or for the sample to continuously burn over a burned length of 5 cm or longer after ignition. An average of 3 measurements was adopted.

Evaluation of Spinnability

Spinnability of fibers was evaluated on the basis of the number of fiber breakage in a process of spinning and fiberizing 50 kg of a resin in accordance with the following criteria:

Good: fiber breakage occurred 0 to 3 times per 50 kg,

Moderate: fiber breakage occurred 4 to 7 times per 50 kg, and

Poor: fiber breakage occurred 8 times or more per 50 kg.

Example 1

A polycarbonate resin with Mw: 52300, Mn: 17300, and Mw/Mn 3.0 was used. The polycarbonate resin contained bisphenol-A-bis(diphenyl phosphate) as a flame retardant at a concentration of 40 ppm in terms of phosphorus and had an LOI value of 34. The resin was melt-extruded using a twin-screw extruder and was discharged through a round-hole nozzle having 100 holes (0.2 mm in diameter) at a spinning temperature of 320° C. With a ratio of a discharge speed to a winding speed (i.e., drafting ratio) adjusted to 143, as-spun fibers were wound at a winding speed of about 1500 m/min. The as-spun fibers had a single fiber fineness of 2.2 dtex and a glass transition temperature Tg of 145° C. The obtained fibers were evaluated, and Table 1 shows the evaluation results.

Example 2

A polycarbonate resin with Mw: 52300, Mn: 17300, and Mw/Mn=3.0 was used. The polycarbonate resin contained bisphenol-A-bis(diphenyl phosphate) as a flame retardant at a concentration of 40 ppm in terms of phosphorus and had an LOI value of 34. The resin was melt-extruded using a twin-screw extruder and was discharged through a round-hole nozzle having 100 holes (0.2 mm in diameter) at a spinning temperature of 320° C. With a ratio of a discharge speed to a winding speed (i.e., drafting ratio) adjusted to 95, as-spun fibers were wound at a winding speed of about 1000 m/min. The as-spun fibers had a single fiber fineness of 3.3 dtex and a glass transition temperature Tg of 145° C. The obtained fibers were evaluated, and Table 1 shows the evaluation results.

Example 3

A polycarbonate resin with Mw: 52300, Mn: 17300, and Mw/Mn=3.0 was used. The polycarbonate resin contained bisphenol-A-bis(diphenyl phosphate) as a flame retardant at a concentration of 40 ppm in terms of phosphorus and had an LOI value of 34. The resin was melt-extruded using a twin-screw extruder and was discharged through a round-hole nozzle having 100 holes (0.2 mm in diameter) at a spinning temperature of 320° C. With a ratio of a discharge speed to a winding speed (i.e., drafting ratio) adjusted to 63, as-spun fibers were wound at a winding speed of about 666 m/min. The as-spun fibers had a single fiber fineness of 4.9 dtex and a glass transition temperature Tg of 145° C. The obtained fibers were evaluated, and Table 1 shows the evaluation results.

Example 4

A polycarbonate resin with Mw: 49800, Mn: 17000, and Mw/Mn=2.9 was used. The polycarbonate resin had an LOI value of 26. The resin was melt-extruded using a twin-screw extruder and was discharged through a round-hole nozzle having 100 holes (0.2 mm in diameter) at a spinning temperature of 320° C. With a ratio of a discharge speed to a winding speed (i.e., drafting ratio) adjusted to 63, as-spun fibers were wound at a winding speed of about 666 m/min. The as-spun fibers had a single fiber fineness of 4.9 dtex and a glass transition temperature Tg of 150° C. The obtained fibers were evaluated, and Table 1 shows the evaluation results.

Comparative Example 1

A polycarbonate resin with Mw: 135000, Mn: 56000, and Mw/Mn=2.4 was used. The polycarbonate resin had an LOT value of 26. The resin was melt-extruded using a twin-screw extruder and was discharged through a round-hole nozzle having 100 holes (0.2 mm in diameter) at a spinning temperature of 290° C. With a ratio of a discharge speed to a winding speed (i.e., drafting ratio) adjusted to 63, as-spun fibers were wound at a winding speed of about 666 m/min. The as-spun fibers had a single fiber fineness of 4.9 dtex. The obtained fibers were evaluated, and Table 1 shows the evaluation results.

Comparative Example 2

A polycarbonate resin with Mw: 49800, Mn: 17000, and Mw/Mn=2.9 was used. The polycarbonate resin had an LOT value of 26. The resin was melt-extruded using a twin-screw extruder and was discharged through a round-hole nozzle having 100 holes (0.2 mm in diameter) at a spinning temperature of 290° C. With a ratio of a discharge speed to a winding speed (i.e., drafting ratio) adjusted to 63, as-spun fibers were wound at a winding speed of about 666 in/min. The as-spun fibers had a single fiber fineness of 4.9 dtex and a glass transition temperature Tg of 150° C. The obtained fibers were evaluated, and Table 1 shows the evaluation results.

Comparative Example 3

A polycarbonate resin with Mw: 90000, Mn: 28000, and Mw/Mn=3.2 was used. The polycarbonate resin contained bisphenol-A-bis(diphenyl phosphate) as a flame retardant at a concentration of 80 ppm in terms of phosphorus and had an LOI value of 37. The resin was melt-extruded using a twin-screw extruder and was discharged through a round-hole nozzle having 100 holes (0.2 mm in diameter) at a spinning temperature of 300° C. With a ratio of a discharge speed to a winding speed (i.e., drafting ratio) adjusted to 63, as-spun fibers were wound at a winding speed of about 666 m/min. The as-spun fibers had a single fiber fineness of 4.9 dtex. The obtained fibers were evaluated, and Table 1 shows the evaluation results.

TABLE 1

| | | Ex. 1 | Ex. 2 | Ex. 3 | Ex. 4 | Com. Ex. 1 | Com. Ex. 2 | Com. Ex. 3 |
|---|---|---|---|---|---|---|---|---|
| Resin | Molecular weight | Mw: 52300 Mn: 17300 | Mw: 52300 Mn: 17300 | Mw: 52300 Mn: 17300 | Mw: 49800 Mn: 17000 | Mw: 135000 Mn: 56000 | Mw: 49800 Mn: 17000 | Mw: 90000 Mn: 28000 |
| | Molecular weight distribution (Mw/Mn) | 3.0 | 3.0 | 3.0 | 2.9 | 2.4 | 2.9 | 3.2 |
| | MFR (g/10 min) | 13 | 13 | 13 | 15 | 3 | 15 | 5 |
| | Melt viscosity (poise) at 320° C., 1000 $s^{-1}$ | 1528 | 1528 | 1528 | 1922 | 5800 | 1922 | 3720 |
| | Flame retardant | Bisphenol-A-bis(diphenyl phosphate) | Bisphenol-A-bis(diphenyl phosphate) | Bisphenol-A-bis(diphenyl phosphate) | — | — | — | Bisphenol-A-bis(diphenyl phosphate) |
| Spinning | Spinning temperature (° C.) | 320 | 320 | 320 | 320 | 290 | 290 | 300 |
| | Discharge speed (m/min) | 10.5 | 10.5 | 10.5 | 10.5 | 10.5 | 10.5 | 10.5 |
| | Winding speed (m/min) | 1500 | 1000 | 666 | 666 | 666 | 666 | 666 |
| | Drafting ratio | 143 | 95 | 63 | 63 | 63 | 63 | 63 |
| | Spinnability | Good | Good | Good | Good | Poor | Good | Poor |
| Fiber | Single fiber fineness (dtex) | 2.2 | 3.3 | 4.9 | 4.9 | 4.9 | 4.9 | 4.9 |
| | Fiber diameter (μm) | 15.0 | 18.4 | 22.4 | 22.4 | 22.4 | 22.4 | 22.4 |
| | CV (%) in fiber diameter | 3.3 | 3.6 | 4.0 | 4.0 | 16.5 | 6.8 | 7.2 |
| | Orientation degree | 0.57 | 0.56 | 0.52 | 0.52 | 0.71 | 0.75 | 0.70 |
| | Birefringence value | 0.008 | 0.007 | 0.006 | 0.006 | 0.042 | 0.045 | 0.043 |
| | Tenacity (cN/dtex) | 1.8 | 1.53 | 1.2 | 1.1 | 2.5 | 2.1 | 2.2 |
| | Elongation (%) | 106 | 147 | 160 | 165 | 39 | 30 | 37 |
| | Elastic Modulus (cN/dtex) | 21.5 | 20.2 | 19.5 | 19.3 | 32.5 | 31.0 | 33.6 |
| | LOI | 24.0 | 24.0 | 24.0 | 24.6 | 23.8 | 24.0 | 28.0 |
| | Dry-heat shrinkage percentage (%) under no tension | 6.5 | 4.0 | 1.3 | 1.3 | 21.0 | 13.0 | 24.0 |

As shown in Table 1, in all of Examples 1 to 4, the polycarbonate fibers can have orientation degrees and birefringence values controlled within predetermined ranges and have reduced dry-heat shrinkage percentages, thanks to melt spinning at high temperature. Therefore, it is possible to suppress defects such as resin spots, warps and/or twists in the melt-molded bodies. Even if the fiber diameters are small, these Examples can have reduced coefficients of variation in the fiber diameters and have good handling properties. The obtained fibers have sufficient tenacity for practical applications and have high elongation as well as improved flame retardancy.

Comparative Example 1, on the other hand, reveals that the polycarbonate resin having a high molecular weight and thus poor melt spinnability is unable to obtain fibers having a controlled orientation degree or a controlled birefringence value, and the obtained fiber has a high dry-heat shrinkage percentage. Therefore, it is difficult to suppress defects such as resin spots, warps and/or twists in a melt-molded body. In Comparative Example 1, fibers are deteriorated in handleability because of high coefficient of variation in the fiber diameter, resulting in fiber unevenness.

In Comparative Example 2, although the polycarbonate resin has good melt spinnability, the obtained fiber has an orientation degree and a birefringence value outside the ranges as specified in the present invention as well as a high dry-heat shrinkage percentage. Therefore, it is difficult to suppress defects such as resin spots, warps and/or twists in a melt-molded body. As compared with the Examples, the fibers in Comparative Example 2 have a high coefficient of variation in the fiber diameter, thus deteriorated in handleability in comparison with Examples.

In Comparative Example 3, the polycarbonate resin has poor melt spinnability, and the obtained fiber has an orientation degree and a birefringence value outside the ranges as specified in the present invention as well as has a high dry-heat shrinkage percentage. Therefore, it is difficult to suppress defects such as resin spots, warps and/or twists in a melt-molded body. As compared with the Examples, the fibers in Comparative Example 3 also have a high coefficient of variation in the fiber diameter, thus deteriorated in handleability in comparison with Examples.

INDUSTRIAL APPLICABILITY

A fiber structure comprising polycarbonate fibers according to the present invention can be suitably used in various applications. Further, polycarbonate fibers in such a fiber structure can be melted to form a matrix of a resin composite body. Such a fiber structure as well as a resin composite body may be highly effectively used in various fields, including general industrial material fields, electrical and electronic fields, civil engineering and construction fields, aircraft, automobile, railroad, and vessel fields, agricultural material fields, optical material fields, medical material fields, etc.

Although the present invention has been described in terms of the preferred Examples thereof, those skilled in the art would readily arrive at various changes and modifications in view of the present specification without departing from the scope of the invention. Accordingly, such changes and modifications are included within the scope of the present invention defined by the appended claims.

What is claimed is:

1. A polycarbonate fiber having an orientation degree (ft) of lower than 0.70 and comprising a polycarbonate resin having a weight-average molecular weight (Mw) of from 45000 to 80000, wherein the orientation degree (ft) is defined by the following formula:

$$ft=1-(1.0/C)^2$$

where C is sonic velocity in terms of km/see of the polycarbonate fiber.

2. The polycarbonate fiber according to claim 1, wherein the polycarbonate fiber has a birefringence value of 0.040 or lower.

3. The polycarbonate fiber according to claim 1, wherein the polycarbonate resin having has a number-average molecular weight (Mn) of from 12000 to 40000.

4. The polycarbonate fiber according to claim 3, wherein the polycarbonate resin has a molecular weight distribution (Mw/Mn) of from 2.0 to 4.0.

5. A polycarbonate fiber having a birefringence value of 0.040 or lower and comprising a polycarbonate resin having a weight-average molecular weight (Mw) of from 45000 to 80000.

6. The polycarbonate fiber according to claim 5, wherein the polycarbonate resin has a molecular weight distribution (Mw/Mn) of from 2.0 to 4.0.

7. The polycarbonate fiber according to claim 1, wherein the polycarbonate fiber has an elastic modulus of 30 cN/dtex or lower.

8. The polycarbonate fiber according to claim 1, wherein the polycarbonate fiber has a coefficient of variation in a fiber diameter of 15% or lower.

9. The polycarbonate fiber according to claim 1, wherein the polycarbonate fiber has a single fiber fineness of 10 dtex or smaller.

10. The polycarbonate fiber according to claim 1, wherein the polycarbonate fiber has an elongation at break of 20% or higher.

11. The polycarbonate fiber according to claim 1, wherein the polycarbonate resin includes bisphenol-A units at a molar proportion of 65% or higher based on a total amount of monomer units in the polycarbonate resin.

12. The polycarbonate fiber according to claim 1, wherein the polycarbonate fiber comprises a phosphorus-based flame retardant.

13. The polycarbonate fiber according to claim 12, wherein the polycarbonate fiber comprises at least one phosphorus-based flame retardant selected from the group consisting of a phosphoric acid ester-based flame retardant, a phosphoric acid salt-based flame retardant, and a phosphazene-based flame retardant.

14. A fiber structure, comprising the polycarbonate fiber according to claim 1.

15. A fiber structure, comprising the polycarbonate fiber according to claim 5.

16. The fiber structure according to claim 14, wherein the fiber structure is commingled fibers, a woven fabric, or a non-woven fabric.

17. A method for producing the polycarbonate fiber according to claim 1, the method comprising:

melt-kneading the polycarbonate resin at a temperature of 305° C. or higher to give a molten polymer;

discharging the molten polymer through a spinning nozzle at a predetermined rate to give as-spun fibers; and winding the as-spun fibers at a predetermined winding speed.

18. The polycarbonate fiber according to claim 5, wherein the polycarbonate resin has a number-average molecular weight (Mn) of from 12000 to 40000.

19. The polycarbonate fiber according to claim 1, wherein the polycarbonate resin has a branching degree of less than 0.1 mol %.

20. The polycarbonate fiber according to claim 1, wherein the polycarbonate fiber has an elongation at break of 80% or higher.

* * * * *